US005289915A

United States Patent [19]

Queen

[11] Patent Number: 5,289,915

[45] Date of Patent: Mar. 1, 1994

[54] KEEPSAKE CAPSULE

[76] Inventor: William L. Queen, 2209 Lynette Dr., Greensboro, N.C. 27403

[21] Appl. No.: 986,080

[22] Filed: Dec. 4, 1992

[51] Int. Cl.[5] ..... A45C 11/00

[52] U.S. Cl. ..... 206/38; 206/37; 206/8; 220/662

[58] Field of Search ..... 206/38, 38.1, 37, 37.1, 206/37.4, 538, 540; 220/503, 522, 521, 8, 402, 662; 70/456 R, 457

[56] References Cited

U.S. PATENT DOCUMENTS

| | | | |
|---|---|---|---|
| 2,892,595 | 6/1959 | Tupper | 206/38 X |
| 3,263,804 | 8/1966 | Marenchin | 206/38 X |
| 4,333,562 | 6/1982 | Todd | 206/37 |
| 4,358,944 | 11/1982 | Stoffel | 70/457 |
| 4,420,076 | 12/1983 | Beveridge et al. | 206/37 |
| 4,519,497 | 5/1985 | Brinkers | 206/37 |
| 4,733,807 | 3/1988 | Porter et al. | 206/37 X |
| 4,854,449 | 8/1989 | Fitzhugh | 206/37 |
| 5,040,394 | 8/1991 | Wang | 70/457 |

*Primary Examiner*—Paul T. Sewell
*Assistant Examiner*—Jacob K. Ackun, Jr.
*Attorney, Agent, or Firm*—Harlan P. Huebner

[57] ABSTRACT

A keepsake transparent capsule having two compartments, one to receive a two dimensional item and the other to receive a three dimensional item, the capsule capable of being secured to a key chain or other physical item for visual inspection and display. The capsule includes an exterior tube and a piston member inserted within the tube.

4 Claims, 1 Drawing Sheet

KEEPSAKE CAPSULE

BACKGROUND OF THE INVENTION

1. Field of the Invention

This invention relates to a transparent capsule that has a first compartment adapted to receive a two dimensional item as well as a second compartment to receive a three dimensional item.

2. Description of the Prior Art

Heretofore there has been provided a transparent container for receiving a photo and the container has an eyelet to receive a key chain which in turn holds keys. Such a structure is illustrated in U.S. Pat. No. 5,040,394 issued to Gohome Wang.

Also there have been provided hinge type of transparent containers for photos where a key ring is build into the container. Such a structure would be found in U.S. Pat. No. 4,358,944 issued to John F. Stoffel.

Each of the above have disadvantages in that they are only adapted for two dimensional items such as photographs.

SUMMARY OF THE INVENTION

It is a purpose of this invention to provide a keepsake capsule that is of such a construction to in effect have two compartments, one to receive a two dimensional item such as a photograph and in the other to receive a three dimensional item such as a lock of hair.

Another object of the present invention is to provide a tubular transparent keepsake capsule having an eyelet at one end to receive a keychain or for affixing the capsule to some other item.

A further object of the present invention is to provide a keepsake capsule that includes a tubular piston means that is adapted to be inserted into a tubular exterior capsule having an end to form a compartment and of a diameter less than the interior of the exterior capsule to form another compartment.

A still further object of the present invention is to provide a keepsake capsule that may be sealed permanently when the desired items are inserted or may be provided with releasable locking means so the items may be changed.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
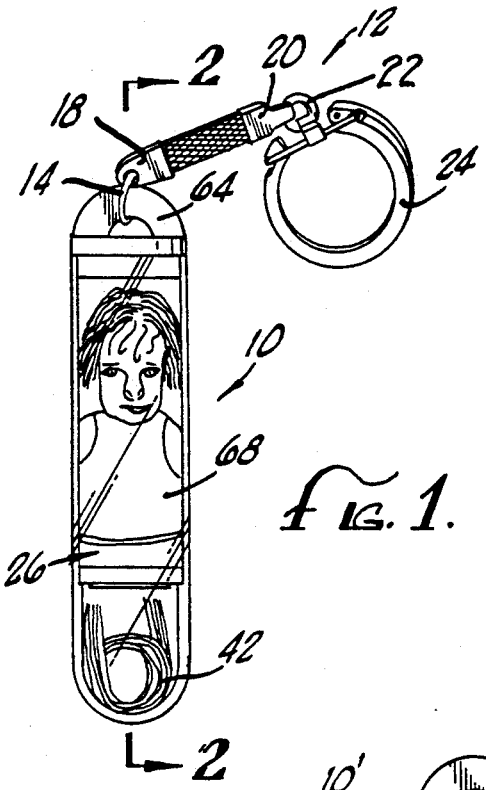
FIG. 1 is an elevational view of the keepsake capsule with items therein and attached to a key ring.
Figure 2:
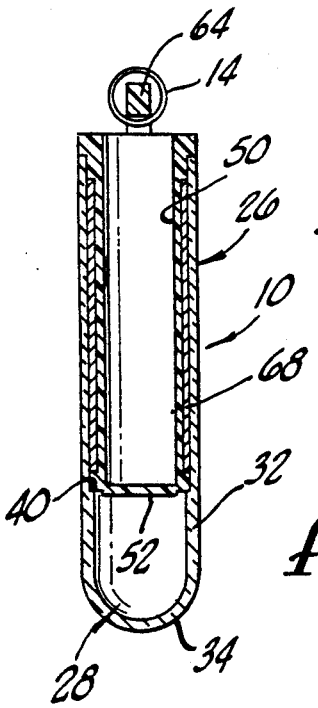
FIG. 2 is an elevational cross-sectional view of the keepsake capsule taken on line 2—2 of FIG. 1.

In FIG. 1 there is illustrated a transparent keepsake capsule generally designated 10. The capsule 10 may be attached to a conventional key ring number designated 12.

The key ring number 12 includes an attachment link 14, attached to a body portion 16 at one end 18 and at the other end 20 an attachment link 22 secures the body portion 16 to a key ring 24 adapted to receive a plurality of keys (not shown).

While it is preferred that the capsule 10 is attached to a key ring, it may be attached to anything such as a zipper, purse, etc. In addition, the capsule 10 may be carried loose in a pocket or purse or displayed in a home, etc., without departing from the spirit of the invention.

The capsule 10 when assembled is a two compartment keepsake capsule 10 with a first compartment designated 26 and a second compartment designated 28.

In addition, in the illustrations, the capsule 10 is preferably a circular cross section tube type structure. However, without departing from the spirit of the invention the tubular structure could be quadrilateral in cross section.

Now turning to the details of structure there is a transparent circular cross section exterior tube 30 preferably formed of clear plastic. The tube 30 has an annular elongated wall 32 of circular cross section with a rounded closed bottom 34. The top 36 is open.

The inner surface 38 includes a circular step 40 near the bottom 34 wherein the thickness of the lower part of the annular elongated wall 32 is thinner than from the step downward and through the rounded closed bottom 34.

The portion of the tube 30 below the step 40 forms the second compartment 28. The purpose of this compartment 28 is to receive a three dimensional keepsake such as a lock of hair 42 or other memento such as sand from the desert as a remembrance of the "Desert Storm" War, etc.

Figure 3:
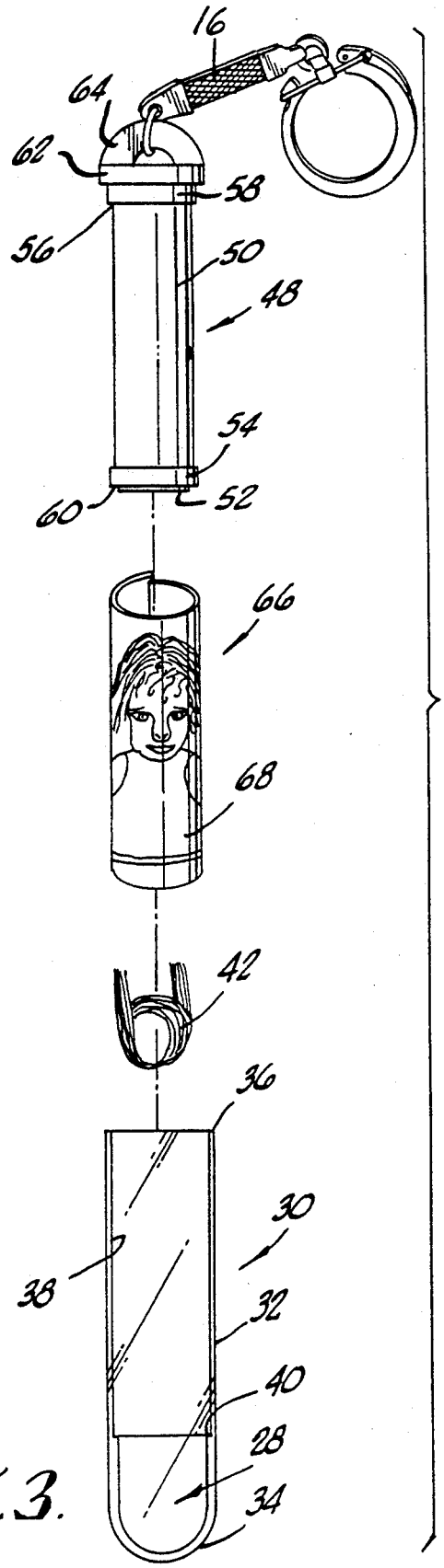
FIG. 3 is an exploded view of the keepsake capsule showing the interfitting of parts as well as the items to be placed into the capsule.

The capsule 10 also includes a piston member designated 48, see FIG. 3, which is adapted to be inserted into the tube 30. The piston member 48 includes an elongated tube 50 of circular cross section which is also preferably formed of plastic. The diameter of the tube 50 is slightly less than the diameter of wall inner surface 38.

The tube 50 is closed at end 52 and around the tube 50 adjacent end 52 there is rib 54 having a circular cross section and of a diameter wider than the tube 50 yet just slightly less than the diameter of wall surface 38.

At the opposite end 56 of the tube 50 there is a second rib 58 of the same diameter as the first rib 54.

The ribs 54 and 58 will guide the elongated piston member 48 into the tube 30. The underside 60 of rib 54 will engage the step 40 to seat the tube 50 in place within the tube 30.

Molded to the rib 58 is a top stop 62 of circular cross section that has a diameter equal to the exterior diameter of the tube 30 so that the stop 62 will engage the top 36 of the tube 30 to enclose the same.

Formed upward from the top stop number 62 is an eyelet 64 to which the key ring member 12 is secured.

To utilize the keepsake capsule 10, a physical three dimensional memento such as a lock of hair 42 is placed at the bottom of the tube 30 in the second compartment 28.

Next, a two dimensional item, designated 66 such, as a photograph 68 is wrapped around the elongated tube 50 between ribs 54 and 58. As the tube 30 has a lesser diameter than the diameter of the ribs 54 and 56 there is a space or first compartment 26 created between the inside surface 38 and tube 50 to accommodate the photo 68.

With the photo or two dimensional item in place around the piston 48, the piston 48 is inserted into the tube 30 and moved downward to the step 40. In this way the capsule is completed.

In order to permanently seal the parts of the capsule 10 together adhesive may be applied to the rib 54 or top stop 62 to hold the tube 30 and piston number 48 together.

Figure 4:
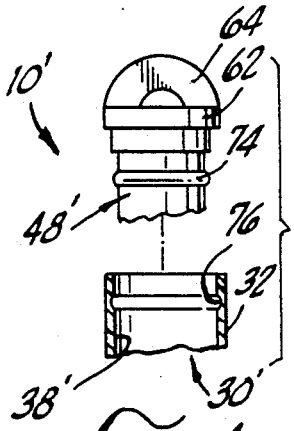
FIG. 4 is a partially exploded view of a modified releasable locking means for the keepsake capsule.

If on the other hand it is desired to allow the capsule 10' to be reopened and the displays changed, then the modification of FIG. 4 could be utilized. Here there is a snap means including a bead 74 formed on the piston 48' and a snap-in groove 76 formed into the inner wall 38'0 of the 30'.

As the piston 48' is pushed into the tube 30' the bead 74 will into the groove 76 and retain the parts until disassembled.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A transparent keepsake capsule for displaying a two dimensional item and a three dimensional item including;

a hollow transparent external tube circular in cross section;

said tube having an open top end and a closed bottom end; a piston member of circular cross section releasably inserted within said external tube having a closed bottom end, an elongated tube portion and an upper and lower spaced rib projecting from said piston member, said ribs engage the interior of said external tube, and said elongated tube portion is of a lessor length than said external tube and a stop above said upper rib is provided to stop said piston member within said external tube;

a first compartment created between said exterior tube and said elongated tube portion to receive a two dimensional keepsake item and extending around said elongated tube portion of said piston member;

a second compartment created at the bottom of said exterior tube between the closed bottom of said external tube and the closed bottom end of said piston member to receive a three dimensional keepsake item; and snap lock means on said capsule for releasably locking together said tube and said piston member, said means comprising a groove that has a circular cross section formed around the interior of said external tube and a rib is formed on said elongated tube portion of said piston member which rib will seat in said groove and releasably lock said tube and said piston member together.

2. A transparent keepsake capsule for displaying a two dimensional item and a three dimensional item as defined in claim 1 wherein:

said elongated tube portion is at least one quarter the length of said exterior tube.

3. A transparent keepsake capsule as defined in claim 1 wherein:

said piston member includes an attachment eyelet projecting from said stop.

4. A transparent keepsake capsule for displaying a two dimensional item and a three dimensional item including:

a hollow transparent external tube of circular cross section, said tube having an open top end and a rounded closed bottom end;

a releasably positioned annular piston member of circular cross section inserted within said external tube, said member having a generally flat closed bottom end, an annular elongated tube portion of circular cross section and upper and lower spaced apart ribs projecting from said tube portion, said ribs of a diameter complimentary with the diameter of the interior of said external tube and said annular elongated tube portion of a diameter less than the diameter of said ribs and of a length less than the length of said external tube;

a first compartment of circular cross section extending around said elongated tube portion between said tube portion and the interior of said hollow external tube to receive a two dimensional keepsake item, said elongated tube portion to support said item;

a second compartment created within said hollow transparent external tube between the rounded closed bottom end and the flat closed bottom end of said piston to receive a three dimensional keepsake item; and snap lock means are provided on said capsule to releasably maintain said piston member within said external tube, and said means includes a groove of circular cross section formed around the interior of said external tube and a rib is formed on said elongated tube portion of said piston member which rib will seat in said groove and releasably lock the members together.

* * * * *